US007922507B2

(12) United States Patent
Wang et al.

(10) Patent No.: US 7,922,507 B2
(45) Date of Patent: Apr. 12, 2011

(54) ELECTRICAL CARD CONNECTOR WITH A FLANGE-LIKE PLANE PORTION FOR GUIDING INSERTION OF A CARD

(75) Inventors: Yong-Jia Wang, ShenZhen (CN); Liang Sun, ShenZhen (CN)

(73) Assignee: Hon Hai Precision Ind, Co., Ltd., New Taipei (TW)

( * ) Notice: Subject to any disclaimer, the term of this patent is extended or adjusted under 35 U.S.C. 154(b) by 80 days.

(21) Appl. No.: 12/384,866

(22) Filed: Apr. 9, 2009

(65) Prior Publication Data

US 2009/0258518 A1 Oct. 15, 2009

(30) Foreign Application Priority Data

Apr. 9, 2008 (CN) ..... 2008 2 0035057

(51) Int. Cl.
*H01R 29/00* (2006.01)

(52) U.S. Cl. ..... 439/188

(58) Field of Classification Search ..... 439/188, 439/607.31, 138, 630
See application file for complete search history.

(56) References Cited

U.S. PATENT DOCUMENTS 4,671,599 A * 6/1987 Olsson ..... 439/188
6,375,483 B1 * 4/2002 Chang ..... 439/188
7,214,076 B1 * 5/2007 Sabo ..... 439/138
7,628,624 B2 * 12/2009 Ye et al. ..... 439/137

* cited by examiner

*Primary Examiner* — Chandrika Prasad
(74) *Attorney, Agent, or Firm* — Ming Chieh Chang; Wei Te Chung; Andrew C. Cheng

(57) ABSTRACT

A card connector, comprising: an insulative housing having a base, first and second sidewalls extending upwardly from two opposite sides of the base, a card receiving space defined by the base and the first and second sidewalls; a plurality of contacts held within the housing, the contacts having contact sections extending beyond the base; a pair of detecting switches including a stable switch and a movable switch both around a region located backwardly of the first sidewall; and a flange-like plane portion on said first sidewall and essentially vertical to said first sidewall, a front guiding entrance defined by said flange-like plane portion, the first sidewall, the second sidewall and the base.

20 Claims, 6 Drawing Sheets

ELECTRICAL CARD CONNECTOR WITH A FLANGE-LIKE PLANE PORTION FOR GUIDING INSERTION OF A CARD

BACKGROUND OF THE INVENTION

1. Field of the invention

The present invention relates to an electrical card connector, and more particularly, to an electrical card connector provided with a guiding section for guiding the card into the electrical card connector to prevent the electrical card from being scraped.

2. Description of Related Art

Electrical cards are known in the art and contain intelligence in the form of a memory circuit or other electronic program. Some form of card readers retrieve the information or data stored on the card. Such cards are used in many applications in today's electronic society, including video cameras, digital still cameras, smart phones, PDAs, music players, ATMs, cable television decoders, toys, games, PC adapters, multi-media cards and other electronic applications, etc.

Example of prior art card-receiving connectors comprises an insulative housing, a shield shell, a plurality of contacts and at least a detecting switch; the shield shell lays over the insulative housing and forms a receiving space together with insulative housing. The detecting switch is established at a side of insulative housing and including a movable switch and a stable switch, the movable switch has a contact portion which is in contact with an electrical card, and the contact portion extends into the receiving space. When the electrical card is inserted into the card connector, the contact portion is always destroyed by irregular move path of the electrical card, the flexibility of the contact portion will be affected and make the contact between the contact portion and the electrical card not stable.

Therefore, an improved electrical card connector is desired to overcome the disadvantages of the prior arts.

SUMMARY OF THE INVENTION

An object, therefore, of the invention is to provide a new and improved electrical card connector of the character described able to ensure the stability of the electrical card in electrical card connector and protect contact portion of detecting switch from being destroyed by the electrical card.

In order to achieve the above-mentioned object, an electrical card connector comprises: an insulative housing having a base, first and second sidewalls extending upwardly from two opposite sides of the base, a card receiving space defined by the base and the first and second sidewalls; a plurality of contacts held within the housing, the contacts having contact sections extending beyond the base; a pair of detecting switches including a stable switch and a movable switch both around a region located backwardly of the first sidewall; and a flange-like plane portion on said first sidewall and essentially vertical to said first sidewall, a front guiding entrance defined by said flange-like plane portion, the first sidewall, the second sidewall and the base.

Other objects, advantages and novel features of the present invention will become more apparent from the following detailed description of the present embodiment when taken in conjunction with the accompanying drawings.

DETAILED DESCRIPTION OF THE INVENTION

Reference will now be made in detail to the preferred embodiment of the present invention.

Figure 1:
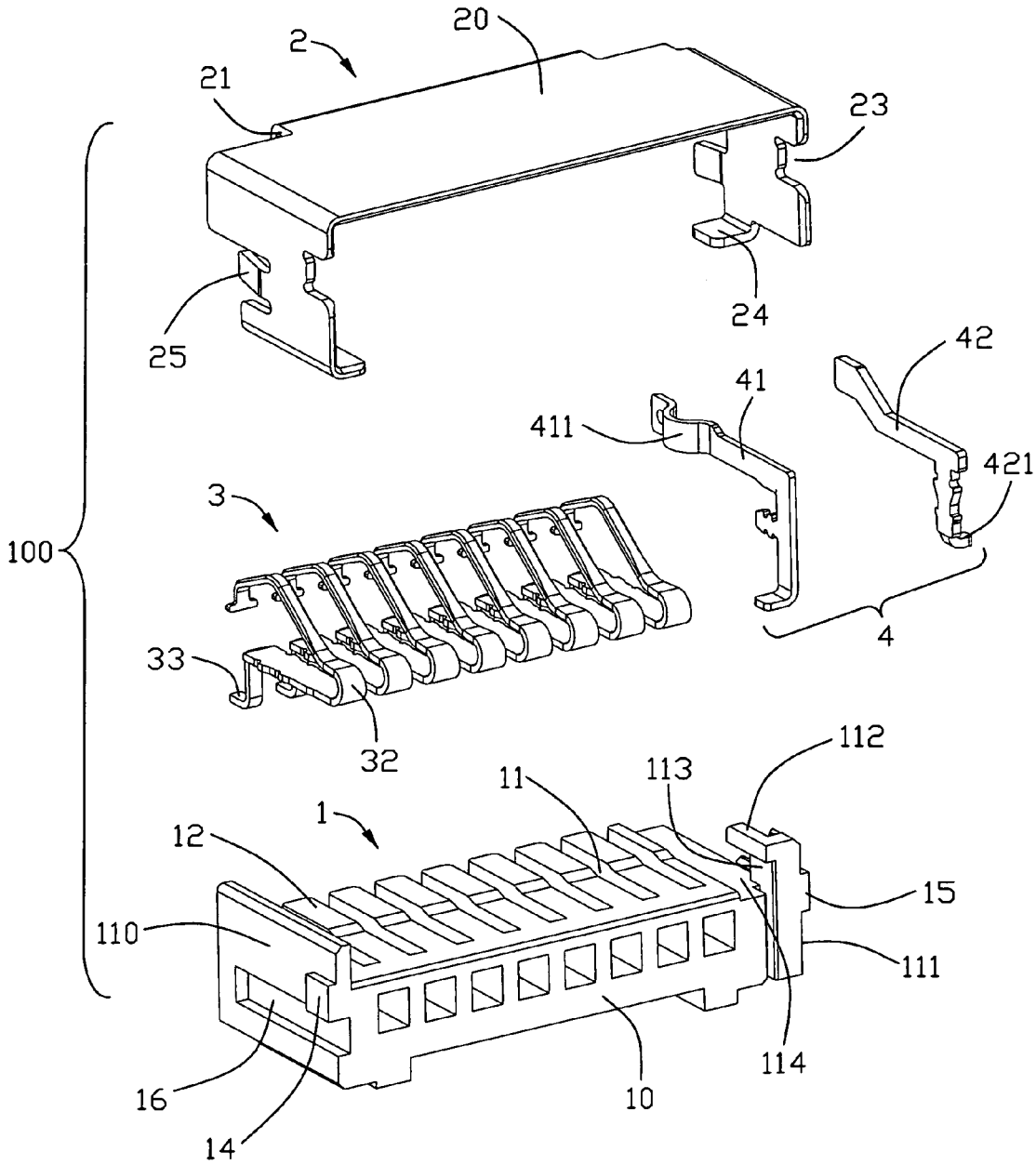
FIG. 1 is an exploded, perspective view of the present invention.
Figure 2:
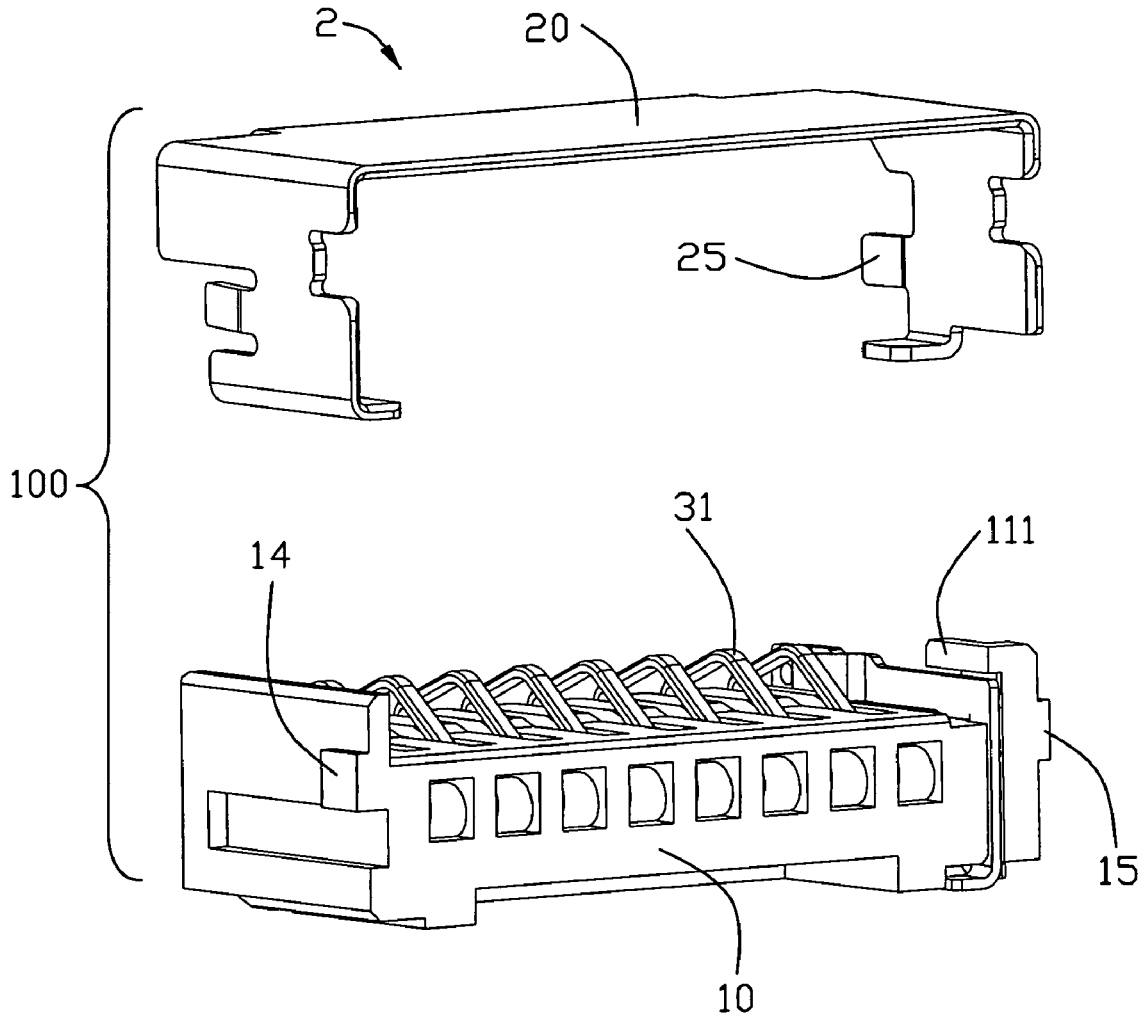
FIG. 2 is a partly-exploded, perspective view of the electrical card connector as shown in FIG. 1.
Figure 3:
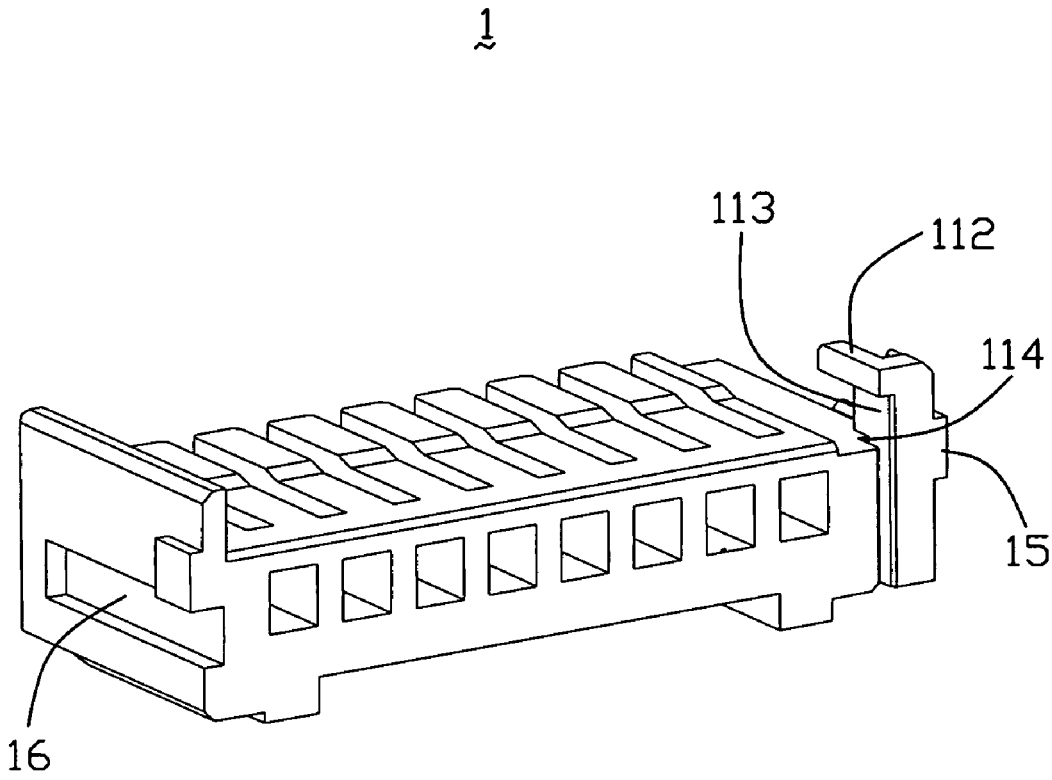
FIG. 3 is a perspective view of an insulative housing of the electrical card connector as shown in FIG. 1.
Figure 4:
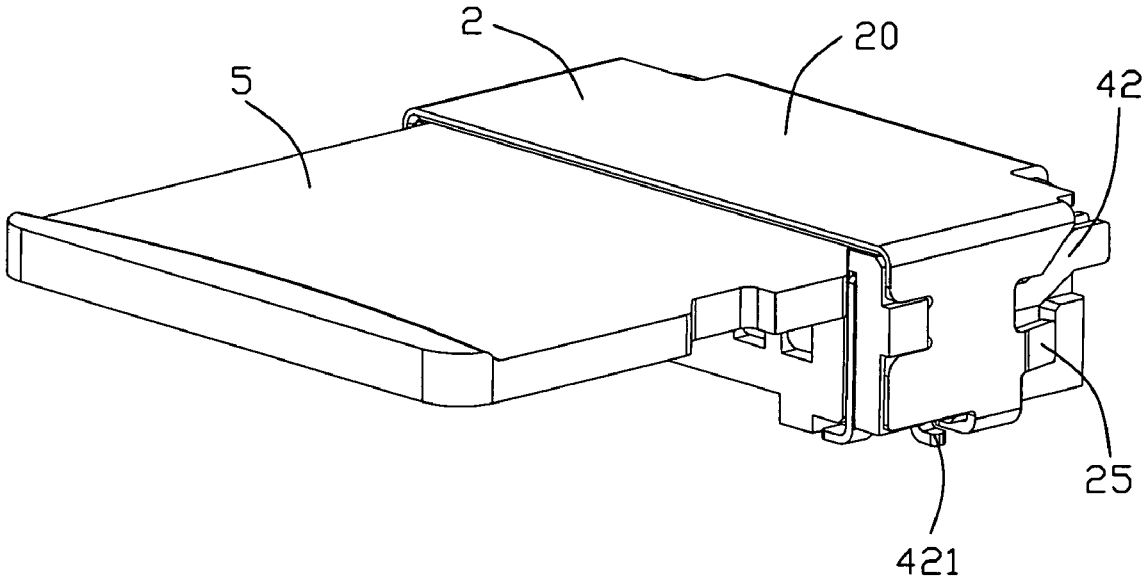
FIG. 4 is an assembled, perspective view of the electrical card connector of FIG. 1, with a card inserted thereinto.
Figure 5:
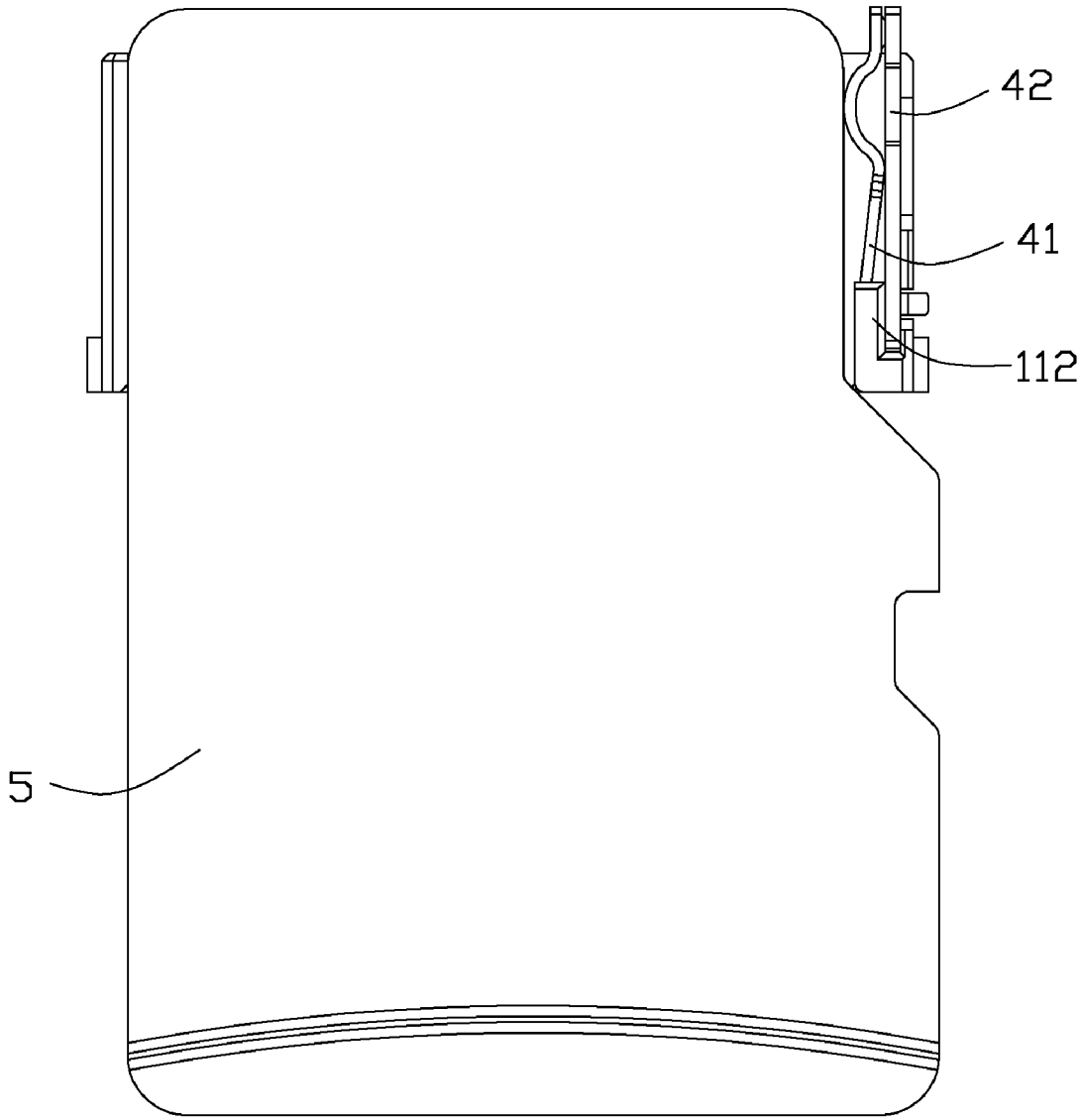
FIG. 5 is a top view of FIG. 4 when a shield shell is removed.
Figure 6:
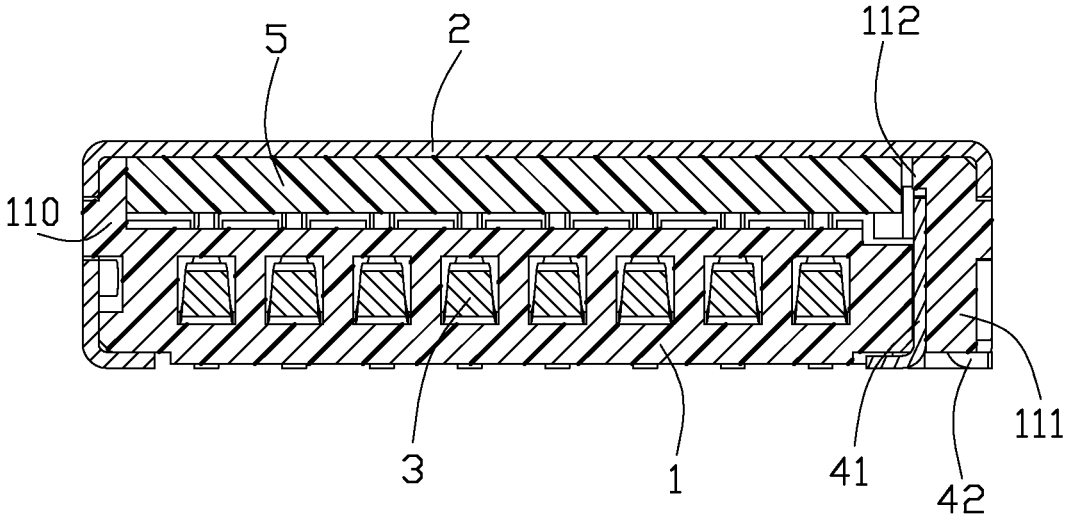
FIG. 6 is a cross-sectional view of the electrical card connector when the card is inserted.

Referring to FIGS. 1-2, an embodiment of the present invention illustrated. An electrical card connector 100 for electrically connecting an electrical card comprises an insulative housing 1 with a plurality of contacts 3 assembled therein; a detecting switch 4 defined in the insulative housing 1; and a shield shell 2 covering the insulative housing 1.

The said insulative housing 1 includes a base 10 presenting a shape of rectangular panel. The insulative housing 1 defines a plurality of receiving passageways 11 therein. A first sidewall 110 and a second sidewall 111 are defined on two sides of the insulative housing 1 which is along an inserting direction of the electrical card 5. The first sidewall 110 has a rear portion 114. A flange-like plane portion 112 is defined on the second sidewall 111 and essentially vertical to said second sidewall 111. A card receiving space 12 is defined by the base 10, the first sidewall 110 and the flange-like plane portion 112. A front entrance 113 is defined by said flange-like plane portion 112, the second sidewall 111 and the base 10. Thus, movement of the card 5 along the predetermined path when guided by the flange-like plane portion 112 does no damage to a movable switch 41, which is often influenced by an excess lateral force from the card 5 if the card 5 moves along an irregular path. The distance between the first sidewall 110 and flange-like plane portion 112 is almost the same with the smallest width of the electrical card 5 which is the foreside of the card 5. The card receiving space 12 is substantially or almost less than half of the card 5, and the card 5 is inserted into the card receiving space 12 partly. Especially, the card receiving space 12 and the flange-like plane portion 112 are positioned at a side-by-side location, such that when the card 5 is inserted, the card 5 is situated only at the side of the flange-like plane portion 112. The fix blocks 14, 15 are defined on the first sidewall 110 and the second sidewall 111 along a lengthwise direction. A groove 16 is defined on each sidewall of the insulative housing 1 under each block 14, 15 and to run through the front surface of insulative housing 1.

The shield shell 2 covers the insulative housing 1, a stop portion 21 is defined on a side of the shield shell 2 extending to the inserting direction of the electrical card 5 and bending vertically to the top surface 20 of the shield shell 2. A retention slot 23 and a retention tab 24 are defined on two ends of shield shell 2 and respectively engage with said block 14, 15. A resilient piece 25 extends to the inner side of the insulative housing 1 on the side which is opposite to the retention slot 23 of shield shell 2.

The contacts 3 are received in the receiving passageways 11 of the insulative housing 1, in order to keep an electrical connection with the electrical card 5, the contact section 31 of the contact 3 laterally invades or protrudes into the receiving space 12 for connection with the card 5. Each contact 3 includes a contact section 31, a connect portion 32 and a soldering portion 33, the soldering portion 33 extends out of the insulative housing 1 and is soldered on the printed circuit board.

The detecting switch 4 includes a movable switch 41 and a stable switch 42. Both the moveable switch 41 and the stable switch 42 are retained with the second sidewall 111, more particularly, the moveable switch 41 is received in the entrance 113 such that the moveable switch 41 is nearer to the card receiving space 12 than the stable switch 42. The movable switch 41 has a contact end 411, and only the contact end 411 laterally extends into the receiving space 12. The moveable switch 41 and the stable switch 42 each comprises a soldering end 421 which keeps an electrical connection with the printed circuit board.

When the electrical card 5 is inserted into the receiving space 12, the contact end 411 of the movable contact 41 is pushed by a corresponding side edge of the electrical card 5 to be leaned towards the stable switch 42, thereby causing the movable switch 41 in contact with the stable switch 42 to form a conduction loop therebetween.

Moreover, the stable switch 42 can be replaced by a portion of the shield shell 2, which is regarded as "a stable switch".

While a preferred embodiment in accordance with the present invention has been shown and described, equivalent modifications and changes known to persons skilled in the art according to the spirit of the present invention are considered within the scope of the present invention as described in the appended claims.

What is claimed is:

1. A card connector, comprising:

an insulative housing having a base, first and second sidewalls extending upwardly from two opposite sides of the base;

a plurality of contacts held within the housing, the contacts having contact sections extending beyond the base;

a pair of detecting switches including a stationary switch and a movable switch both located around the second sidewall; and a flange-like plane portion on said second sidewall and substantially vertical to said second sidewall, a card receiving space defined by the base, the first sidewall and the flange-like plane portion, a front entrance defined by said flange-like plane portion, the second sidewall and the base; wherein the movable switch is received in the entrance.

2. The card connector as described in claim 1, wherein the card connector further includes a shield shell retained on the insulative housing.

3. The card connector as described in claim 1, wherein the insulative housing includes a top surface, a stop portion extending vertically from a side of the top surface.

4. The card connector as described in claim 1, wherein the shield shell has a resilient piece, the resilient piece is defined on each side of shield shell, a groove is defined on each sidewall of insulative housing, and the resilient piece extends into the groove.

5. The card connector as described in claim 1, wherein the movable switch includes a contact end bent into the receiving space.

6. The card connector as described in claim 1, wherein a fix block protrudes from each sidewall of the insulative housing and the shield shell defines a retention slot, and the fix block is retained in the retention slot.

7. The card connector as described in claim 1, wherein an inserted card and the flange-like planar portion are positioned at a side-by-side location.

8. The card connector as described in claim 1, wherein the moveable switch is retained within the second sidewall, having a contacting portion extending into the card receiving space.

9. An electrical card connector comprising:

an insulative housing defining an elongated main body, along a lengthwise direction, with a plurality of passageways extending in a front-to-back direction perpendicular to said lengthwise direction;

a pair of raised walls extending, at two opposite ends of the housing, beyond a top face of the housing wherein one of said raised walls further defines a flange horizontally extending inwardly in said lengthwise direction;

a plurality of contacts disposed in the corresponding passageways, respectively, each of said contacts defining a deflectable contacting section extending above the top face; and a metallic shell assembled upon the housing and including a top plate cooperating with the top face; wherein said flange cooperates with the other of said raised walls, the top plate, and the top face to define a card receiving cavity therebetween.

10. The electrical card connector as claimed in claim 9, wherein the top plate is seated upon the flange.

11. The electrical card connector as claimed in claim 9, wherein the top face forms a raised portion on a rear edge region.

12. The electrical card connector as claimed in claim 9, wherein the card receiving cavity is dimensioned to receive less than half length of a card.

13. The electrical card connector as claimed in claim 9, wherein the card receiving cavity is dimensioned to receive the smallest width of a card.

14. The electrical card connector as claimed in claim 9, wherein an inserted card and the flange are positioned at a side-by-side location.

15. An electrical card connector comprising:

an insulative housing defining an elongated main body, along a lengthwise direction, with a plurality of passageways extending therethrough in a front-to-back direction perpendicular to said lengthwise direction;

a pair of raised walls extending, at two opposite ends of the housing, beyond a top face of the housing wherein one of said raised walls further defines a flange horizontally extending inwardly in said lengthwise direction;

a plurality of contacts disposed in the corresponding passageways, respectively, each of said contacts defining a deflectable contacting section extending above the top face; and a metallic shell assembled upon the housing and including a top plate cooperating with the top face to defining a card receiving cavity therebetween; wherein said flange is located at an insertion opening of said card receiving cavity and configured to be received in a front cutout of an electronic card when said card is received in the card receiving cavity; wherein a moveable switch contact assembled to the housing, defines a contact end positioned behind the flange in the front-to-back direction and configured to be engaged with a side edge of the electronic card beside said front cutout.

16. The electrical card connector as claimed in claim 15, wherein the top plate is seated upon the flange.

17. The electrical card connector as claimed in claim 15, wherein the top face forms a raised portion on a rear edge region.

18. The electrical card connector as claimed in claim 15, wherein said moveable switch contact defines a horizontally extending flexible arm essentially intimately located below the flange.

19. The electrical card connector as claimed in claim 18, wherein said housing is configured to allow said moveable switch contact to be assembled thereto only in said front-to-back direction.

20. The electrical card connector as claimed in claim 19, further including a stationary switch contact located beside the moveable switch contact and assembled to the housing in a vertical direction perpendicular to said front-to-back direction and said lengthwise direction.

* * * * *